United States Patent [19]

Westrom

[11] 3,945,699

[45] Mar. 23, 1976

[54] ELECTRIC CONNECTOR APPARATUS AND METHOD

[75] Inventor: Arthur C. Westrom, Stone Mountain, Ga.

[73] Assignee: Kearney-National Inc., Atlanta, Ga.

[22] Filed: Sept. 27, 1974

[21] Appl. No.: 509,959

[52] U.S. Cl. ..... 339/12 R; 339/111; 339/143 T

[51] Int. Cl.[2] ..... H01R 11/30

[58] Field of Search ..... 339/12 R, 111, 143 R

[56] References Cited

UNITED STATES PATENTS

| | | | |
|---|---|---|---|
| 3,617,987 | 11/1971 | Sankey | 339/111 |
| 3,670,287 | 6/1972 | Keto | 339/12 R |

*Primary Examiner*—Roy Lake
*Assistant Examiner*—DeWalden W. Jones
*Attorney, Agent, or Firm*—Walter M. Rodgers

[57] ABSTRACT

An electric terminal bushing having a hollow tubular contact engageable with the contact pin of an electric elbow type connector is arranged so as substantially to reduce the arcing time during a switch closing operation and includes means for slidably mounting the hollow tubular contact within the bushing and magnetic means connected in series with the contact for imparting sliding closing movement thereto in response to the striking of an electric arc between the contact pin and the tubular hollow contact.

11 Claims, 6 Drawing Figures

ELECTRIC CONNECTOR APPARATUS AND METHOD

Gas generated by an electric arc within the bushing structure of an electric terminal bushing may be very harmful because the pressure built up during high current fault conditions may be sufficient to damage severely or even destroy the bushing. Furthermore if an operator imparts a low velocity closing movement to the movable connector, the time elapsed while the arc exists may be sufficient to damage severely the conducting elements of the contact structure and a substantial quantity of gas may be produced which may tend to impede the closing operation and may also damage the bushing. Furthermore bushings which have been called upon to perform a substantial number of switch opening and closing operations may accumulate carbon deposits which effectively increase the distance between the contacts at which an arc initially strikes. Under these conditions arcing time is prolonged and the attendant production of gas is increased.

One approach to reducing arcing time and the attendant production of an undesired large volume of gas has caused such arc produced gases to operate a piston in such a manner as to accelerate contact closing movement so as to reduce the closing time thereby to limit the duration of the arc and the attendant production of a large volume of gas. This procedure in a sense is self defeating because the gas which is relied upon to effect prompt closing of the contacts also inherently tends to impede the closing operation to a degree and for this reason is objectionable.

According to this invention, the duration of an electric arc during switch closing operations is substantially reduced by the provision of magnetic means in series with a contact movably mounted within a bushing and arranged so as to impart switch closing sliding movement to the bushing contact from its normal position toward an interim position and which drives the contact toward the cooperating contact pin when an electric arc strikes between the tubular bushing contact and the contact pin.

Figure 1:
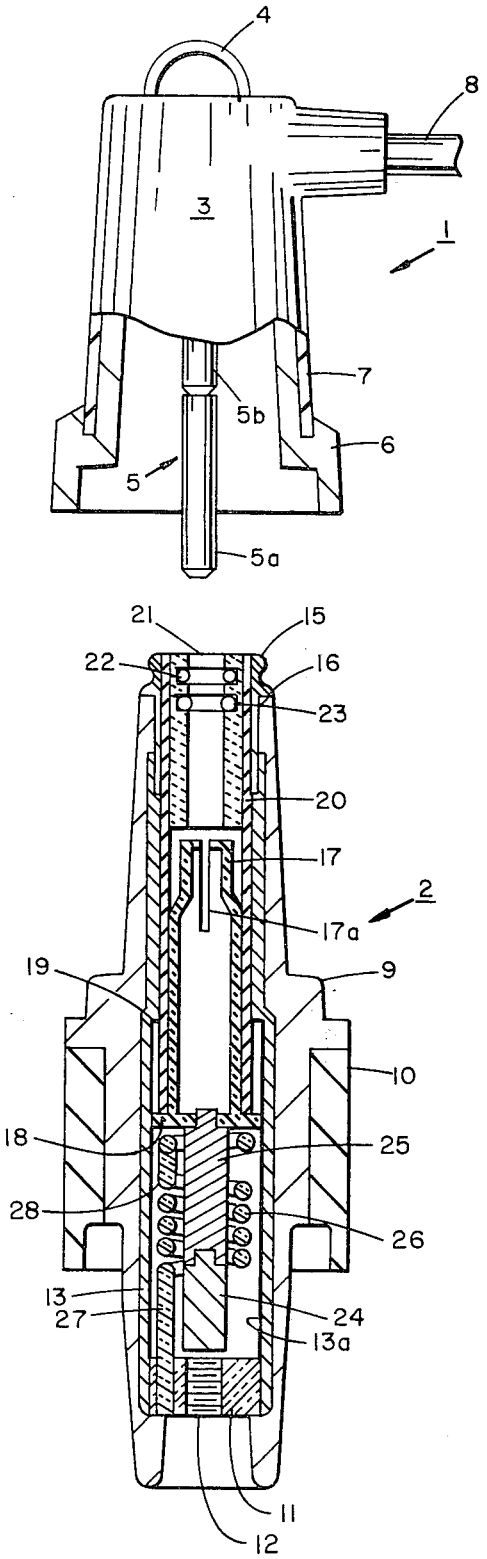
Figure 2:
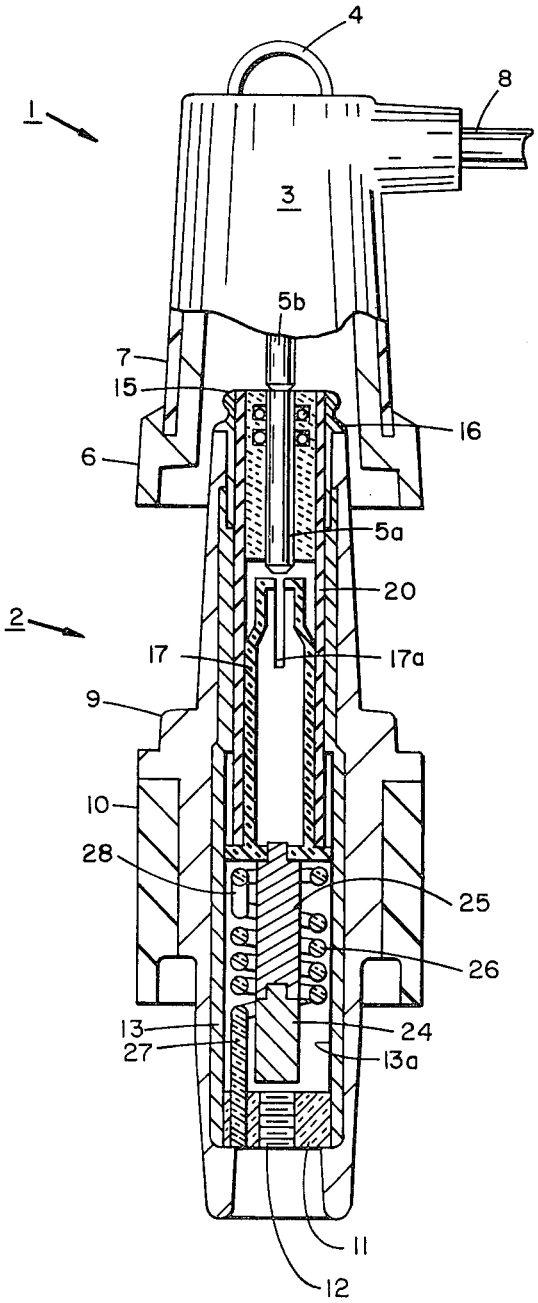
Figure 3:
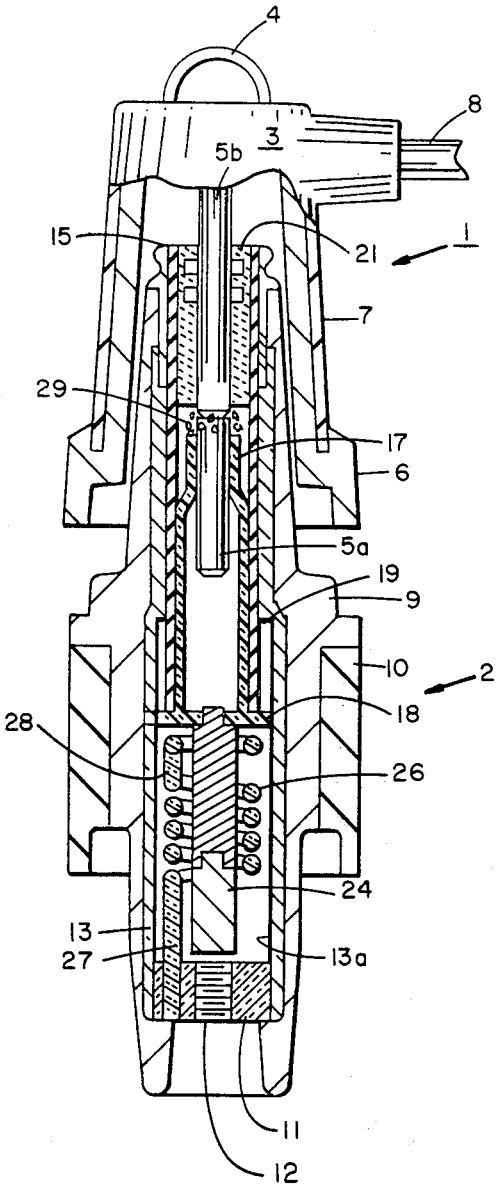
Figure 4:
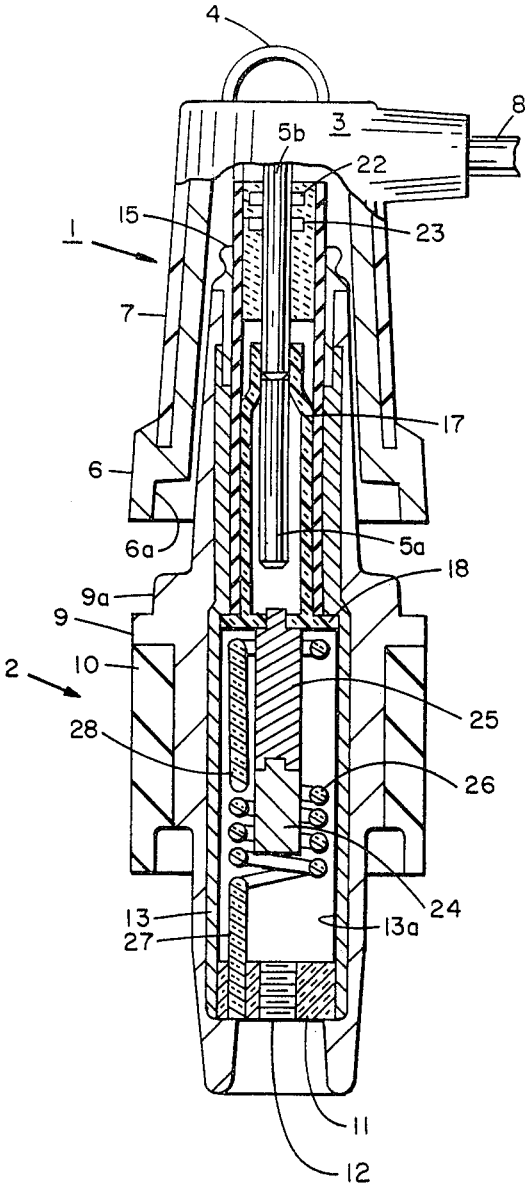
Figure 5:
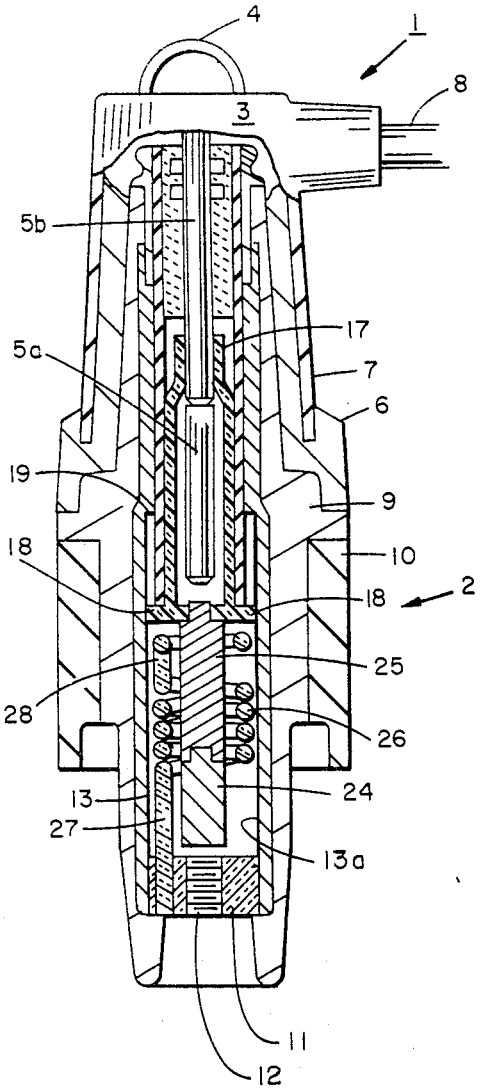
Figure 6:
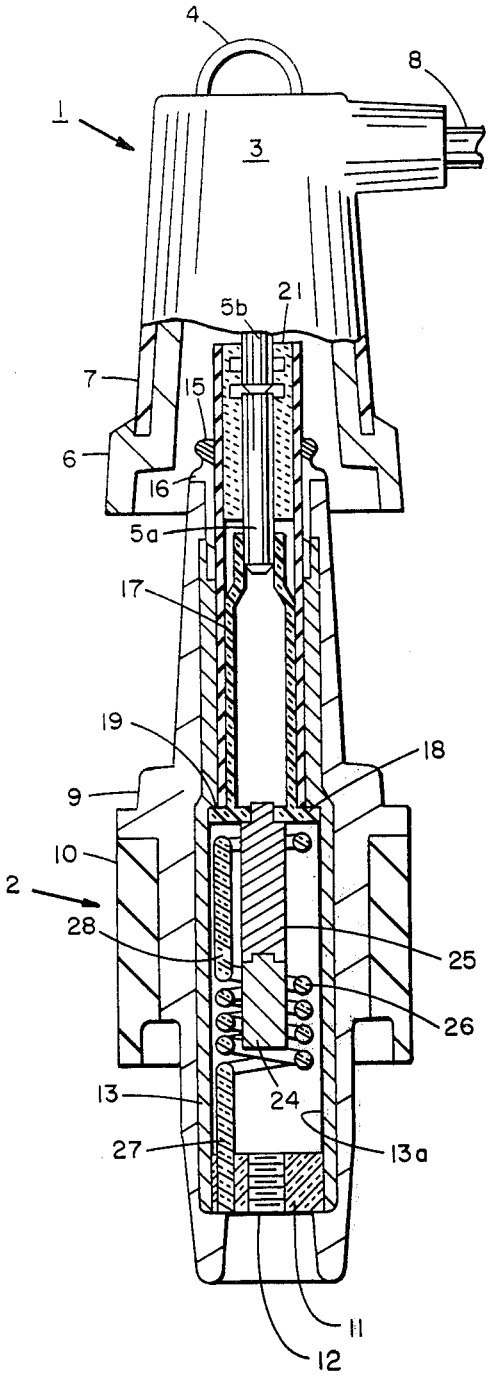

For a better understanding of the invention reference may be had to the following detailed description taken in conjunction with the accompanying drawings in which FIG. 1 is a cross-sectional view of a terminal bushing and of an associated elbow type connector shown partially in section and spaced from the bushing to show an open circuit condition; FIG. 2 is a view similar to FIG. 1 but shows the parts in the normal positions they occupy during the initial stages of a switch closing operation; FIG. 3 is a view similar to FIG. 2 but shows the parts in the positions which they occupy at the instant when an electric arc is initiated between the contacts; FIG. 4 depicts the parts in the interim positions which they occupy immediately following movement of the bushing contact toward the connector contact pin to complete a contact closing operation; FIG. 5 shows the contacts in their fully closed normal positions and with the elbow connector in its closed position relative to the bushing; and in which FIG. 6 represents the parts during an intermediate phase of an opening operation.

With reference to the drawings, the numeral 1 generally designates an elbow type connector arranged to cooperate with a bushing terminal generally designated by the numeral 2. As is well known, the bushing 2 constitutes an exterior terminal for electric apparatus such as a transformer (not shown).

Electric connector 1 is of conventional construction and comprises housing structure 3 to which is affixed a loop 4 and within which is disposed a contact pin 5 having an end portion 5*a* constructed of insulating material and a conducting portion 5*b*. Housing 3 ordinarily includes an insulating structure 6 together with a semi-conductive structure 7. Preferably housing structures 6 and 7 are formed of elastomeric material. Insulated conductor 8 is connected with contact pin 5 within housing 3.

Terminal bushing 2 comprises a hollow elongated support structure in the form of elastomeric sleeve 9 formed of insulating material together with elastomeric material 10 formed of semi-conducting material in known manner. Disposed within the housing structure 9,10 is a conducting element 11 having an internally threaded aperture 12 for receiving an externally threaded conducting element (not shown) but which forms a part of a transformer winding, for example. A metallic sleeve 13 is secured to and envelops the electric conductor 11 and extends upwardly toward the upper end of the bushing 2. Sleeve 13 forms a part of the support structure and is lined with an insulating layer 13a for a portion of its length and is provided with a shoulder 14 which engages the lower end of a cylindrical sleeve 15 having an outwardly projecting flange 16. Sleeve 13 could be formed of non-conducting material and the layer 13*a* could be eliminated. Sleeve 15 and its flange 16 are preferably formed of mechanically strong plastic material and the sleeve and its flange are fixed in position relative to the housing 9 of elastomeric material and to the sleeve 13.

According to this invention the hollow tubular contact 17 having its upper end slotted as shown at 17*a*, is slidably mounted and longitudinally movable within sleeve 13 and is driven upwardly toward an interim position and into engagement with the conducting pin 5*b* immediately following the striking of an arc between the conducting contact pin 5*b* and the contact 17. Toward this end contact 17 is provided with an outwardly projecting shoulder 18 which engages the inwardly projecting shoulder 19 formed in the fixed sleeve 13 to determine the interim position of contact 17. In this way the upper limit of travel of contact 17 is determined. A plastic insulating sleeve 20 is secured to and movable with the contact 17.

For the purpose of aiding in the extinguishment of electric arcs drawn between the contact 5*b* and the tubular hollow contact 17, a quench tube 21 is fixedly mounted within the upper end of plastic sleeve 20. Quench tube 21 preferably incorporates a pair of O-rings 22 and 23 disposed about the inner surface of the hollow quench tube 21 and disposed in internal grooves formed within the quench tube. Quench tube 21 is formed of arc extinguishing material and is securely affixed within the upper end of plastic sleeve 20 so that the structure including sleeve 20, contact 17 and quench tube 21 is vertically reciprocable within the bushing 2 between the lower position shown in FIG. 1 and an upper position as represented, for example, in FIGS. 4 and 6.

For the purpose of imparting upward movement to the contact 17 and associated plastic sleeve 20 and tube 21, magnetic means is provided and may comprise a steel armature 24 secured to an insulating link 25 connected to the bottom end of contact 17 together with a magnetic coil 26 which at its lower end is interconnected with conductor 11 through conductor 27 and which at its upper end is connected with contact 17 through flexible conductor 28. Insulating liner 13*a* isolates coil 26 and associated conductors from tube 13. Conductor 27 is a rigid structure as is the coil 26 so that in effect the coil is fixed in position relative to conductor 11. Since the armature 24 is affixed to the contact 17 via insulating link 25, contact 17 is driven upwardly when the coil 26 is energized. Such movement is accommodated by the flexible conductor 28. Of course the invention is not limited to the particular coil structure 26 and conductors 27 and 28. Some other equivalent could well be employed if desired. For example, the lower end of conductor 17 could be interconnected with conductor 11 by a sinusoidal flexible conductor which upon energization with a current of substantial magnitude would tend to expand in a vertical direction and thus tend to drive the contact 17 upwardly.

In order to effect a contact closing operation, the connector 1 is lowered from the position shown for example in FIG. 1 toward the bushing 2. An initial stage of closing is depicted in FIG. 2. The position represented in FIG. 2 is such that the lower end of insulating portion 5*a* of the contact pin 5 is immediately adjacent the upper end of hollow contact 17.

A subsequent stage in a closing operation is shown in FIG. 3. In this figure the lower end of the conducting portion 5*b* of the contact pin 5 is adjacent to the upper end of contact 17. In FIG. 3 an arc represented at 29 has been established which in turn establishes a flow of current through the flexible conductor 28, the fixed coil 27, the conductor 11, and the winding of the associated transformer. This flow of current imparts an upward force to the steel armature 24 and in turn to the contact 17, the tube 20, and the snuffer 21.

FIG. 4 depicts the contact 17 in its upper position due to the action of the magnetic means comprising armature 24 and fixed coil 27, the upper limit of travel being determined by engagement of shoulder 18 on the contact 17 with the shoulder 19 forming a part of metallic sleeve 13. Of course flexible conductor 28 extends and allows the metallic armature 24 to move upwardly from its lower position depicted in FIGS. 1, 2 and 3 to the upper position shown in FIG. 4. This movement through the agency of insulating link 25 drives the contact 17 into enveloping relationship with respect to the lower end of the conducting part 5*b* of the contact pin 5, the lower portion of the contact pin 5, designated 5*a*, being disposed within the tubular contact 17. In this condition the contacts 5*b* and 17 are closed and the arc is extinguished.

Thus by the invention it is apparent that the quick upward travel of the contact 17 from the normal position shown in FIG. 3 when the arc 29 is initially established to the upper position represented in FIG. 4 substantially reduces the duration of the arc and in turn substantially limits the formation of gas within the support structure comprising the bushing 2. By this means internal pressures are limited and effectively controlled and damaged to the bushing 2 substantially minimized or eliminated. Furthermore since the arcing time is substantially reduced, the deleterious effects of arcing between the contacts 5*b* and 17 are minimized.

FIG. 4 shows the contacts 5*b* and 17 fully closed. This figure however depicts the housing structure 6 and 7 in the positions which these parts occupy just prior to a fully closed condition. Thus with the parts in the positions represented by FIG. 4, the elbow connector 1 is lowered until the surface 6*a* of the housing 6 engages the surface 9*a* of the bushing housing insulating material 9. When these surfaces come into cooperative engagement, the parts occupy the normal positions depicted in FIG. 5 and the circuit is completely closed.

In order to separate the contacts, the elbow connector 1 is simply elevated. The frictional relationship between contact pin 5 and hollow contact 17 causes contact 17 to move upwardly when connector 1 is lifted. Toward this end a hook stick or other suitable manipulative apparatus is engaged with the operating hook 4 and an upward force exerted thereon to cause the connector 1 to move from the position depicted in FIG. 5 to an intermediate position depicted in FIG. 6. In FIG. 6 the shoulder 18 formed at the bottom of the contact 17 is shown engaging the internal shoulder 19 formed in fixed tube 13, and upward movement of contact 17 and parts associated therewith is suddenly arrested. This sudden stoppage of upward movement of the contact 17 imparts a snap action opening operation whereby the lower end of the conducting part 5*b* of contact pin 5 is quickly separated from the upper end of hollow contact 17 and the arc drawn between these contacts is effectively and quickly extinguished by the known action of the insulating part 5*a* of the contact pin 5 in cooperation with the quench tube 15. Continued upward movement of elbow connector 1 results in a complete separation of elbow 1 and bushing 2 to cause the parts to occupy open circuit positions analogous to those represented in FIG. 1.

The embodiments of the invention in which an exclusive property or privilege is claimed are defined as follows:

1. Electric connector apparatus comprising hollow elongated support structure, a tubular electric contact mounted within said support structure and movable longitudinally relative thereto between a normal closed circuit position and an interim position, said interim position being spaced longitudinally from said normal position, and magnetic means interconnected with said contact and operable in coordination with the initiation of the flow of electric current therethrough for moving said contact from its normal position toward its interim position, movement of said contact from its normal position toward its interim position being in a circuit closing direction.

2. Electric apparatus according to claim 1 wherein said magnetic means comprises an armature affixed to and movable with said contact.

3. Electric apparatus according to claim 1 wherein said magnetic means comprises an electrically conductive coil connected in series with said contact.

4. Electric apparatus according to claim 3 wherein said conductive coil is fixedly mounted on said support structure and electrically connected with said contact through conductive means arranged to accommodate relative movement between said contact and said coil.

5. Electric apparatus according to claim 1 wherein said support structure comprises an electric bushing and wherein the flow of current through said contact is initiated by the striking of an electric arc between said contact and a cooperating relatively movable contact during a circuit closing operation.

6. Electric apparatus according to claim 5 wherein movement of said contact toward its interim position following the striking of an arc effectively reduces the duration of the arc.

7. Electric apparatus according to claim 5 wherein said contact comprises a hollow tubular structure slidably mounted within said bushing.

8. Electric apparatus according to claim 7 wherein the interim position of said contact is determined by cooperating abutments on said contact and on said bushing.

9. Electric apparatus according to claim 8 wherein engagement between said abutments during a circuit opening operation imparts a snap action separation between said slidably mounted contact and a cooperating frictionally related contact by arresting movement of said slidably mounted contact.

10. A method of closing a pair of relatively movable electric contacts comprising the steps of moving one of said contacts toward the other of said contacts, quickly moving the other of said contacts from a normal position and toward said one contact to an interim position and into engagement therewith at a velocity of movement which is substantially solely dependent on the magnitude of current in an electric arc struck between said contacts, and finally moving said contacts in unison until said other contact reaches its normal position.

11. A method of separating a pair of closed relatively movable frictionally related electric contacts comprising the steps of imparting an opening force to one of said contacts thereby causing said contacts to move in unison and causing the other of said contacts to move from a normal position to an interim position, arresting movement of said other contact at its interim position while continuing to impart an opening force to said one contact which is sufficient to overcome the friction force tending to hold the contacts closed to separate said contacts, and finally restoring said other contact to its normal position following separation of said contacts.

* * * * *

Disclaimer 3,945,699.—*Arthur C. Westrom*, Stone Mountain, Ga. ELECTRIC CONNECTOR APPARATUS AND METHOD. Patent dated Mar. 23, 1976. Disclaimer filed Mar. 4, 1977, by the assignee, *Kearney-National Inc.*

Hereby enters this disclaimer to claim 11 of said patent.

[*Official Gazette May 3, 1977.*]